United States Patent [19]

Klatt et al.

[11] Patent Number: 4,466,383

[45] Date of Patent: Aug. 21, 1984

[54] BOILER CLEANING OPTIMIZATION WITH FOULING RATE IDENTIFICATION

[75] Inventors: John H. Klatt, Laurel, Md.; Theodore N. Matsko, Chesterland, Ohio

[73] Assignee: The Babcock & Wilcox Company, New Orleans, La.

[21] Appl. No.: 541,394

[22] Filed: Oct. 12, 1983

[51] Int. Cl.[3] ..... F22B 37/48

[52] U.S. Cl. ..... 122/379; 15/316 A; 122/392; 165/95

[58] Field of Search ..... 122/379, 390, 392; 15/316 R, 316 A; 165/95

[56] References Cited

U.S. PATENT DOCUMENTS

| | | | |
|---|---|---|---|
| 2,948,013 | 8/1966 | Bearer, Jr. | 122/392 X |
| 3,396,706 | 8/1968 | Rayburn | 122/390 X |
| 3,680,531 | 8/1972 | Holdt | 122/379 |
| 3,785,351 | 1/1974 | Hall | 122/379 X |
| 3,831,561 | 8/1974 | Yamamoto et al. | 122/379 |
| 4,085,438 | 4/1978 | Butler | 122/392 X |

*Primary Examiner*—Edward G. Favors

*Attorney, Agent, or Firm*—Vytas R. Matas; Robert J. Edwards

[57] ABSTRACT

A method of optimizing the scheduling time between sootblowing operations in a boiler having a plurality of heat traps, comprises measuring the instantaneous efficiency for each heat trap of the boiler, using a filter constant and the amount of load under which the heat trap is placed to calculate an average slope for the loss of efficiency between sootblowing operations and calculating an optimum scheduling period between sootblowing operations as a function of a cost factor reflecting the cost of a sootblowing operation, the duration of the sootblowing operation and the slope.

4 Claims, 10 Drawing Figures

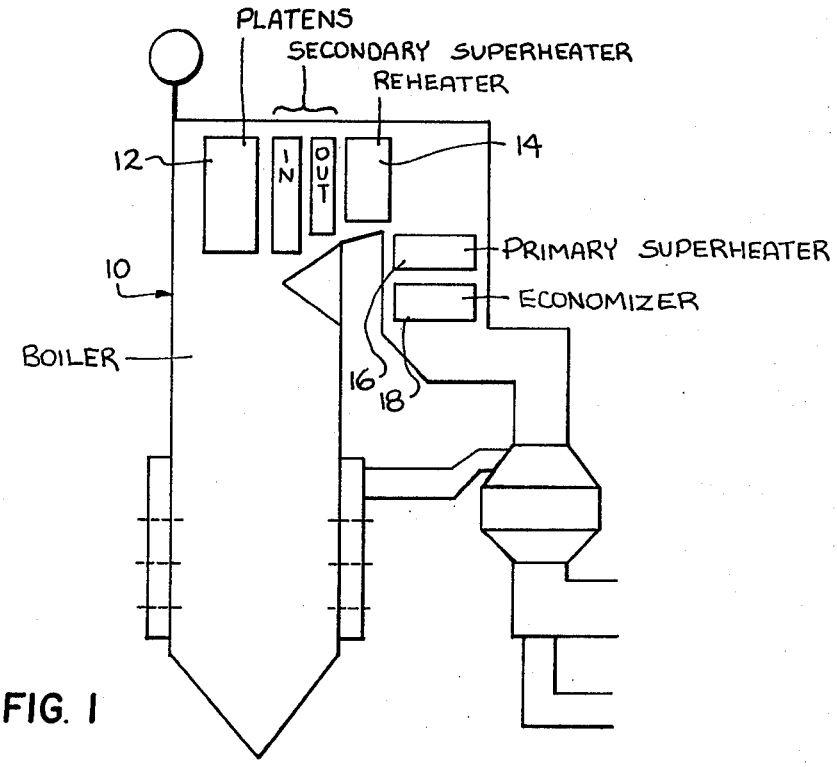
FIG. 1
FIG. 2
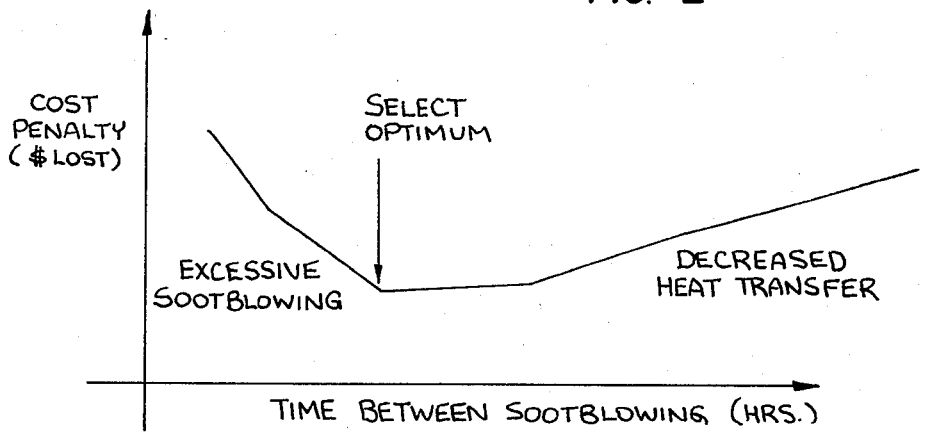

FIG. 8
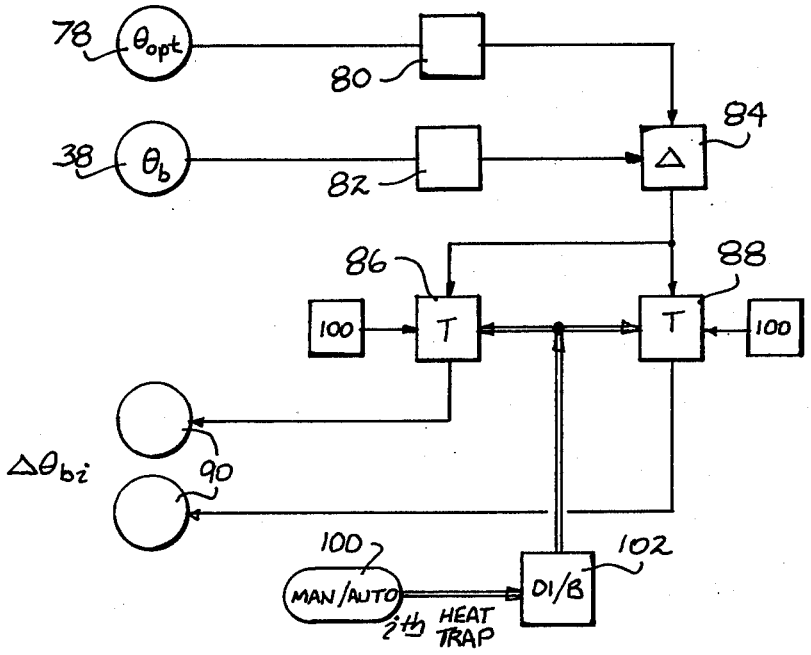
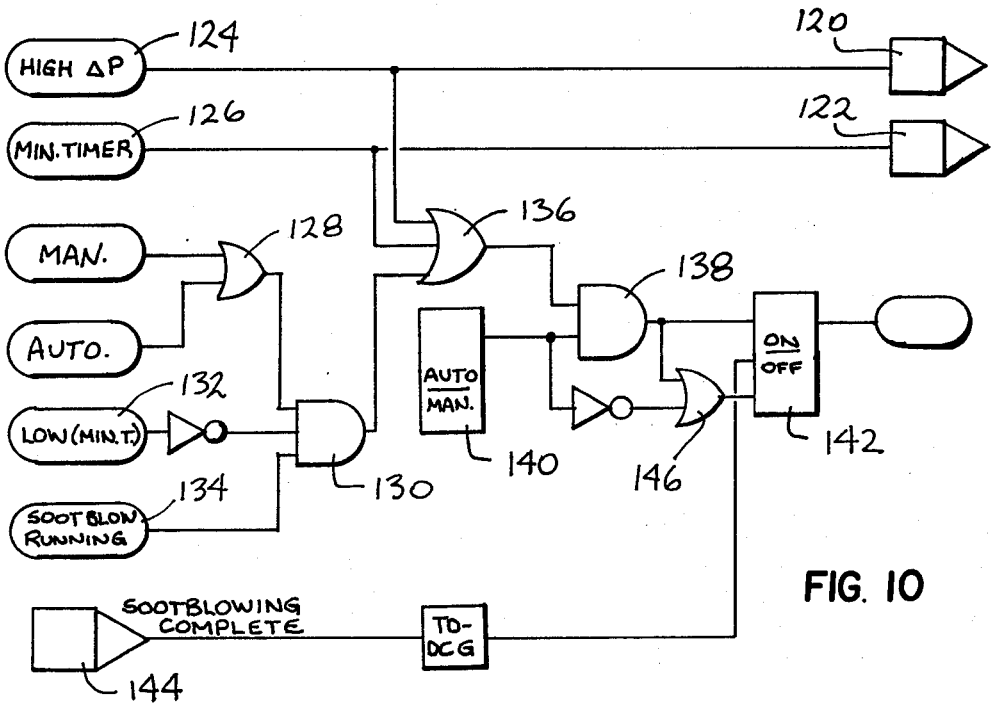
FIG. 10

BOILER CLEANING OPTIMIZATION WITH FOULING RATE IDENTIFICATION

FIELD AND BACKGROUND OF THE INVENTION

The present invention relates, in general, to fossil or other organic fuel boilers and, in particular, to a new and useful method of optimizing the scheduled timing of sootblowing in such boilers.

The combustion of fossil fuels for the production of steam or power generates a residue broadly known as ash. All but a few fuels have solid residues, and in some instances, the quantity is considerable (see Table I).

For continuous operation, removal of ash is essential. In suspension firing the ash particles are carried out of the boiler furnace by the gas stream and form deposits on the tubes in the gas passes (fouling). Under some circumstances, the deposits may lead to corrosion of these surfaces.

Some means must be provided to remove the ash from the boiler surfaces since ash in its various forms may seriously interfere with operation or even cause shutdown. Furnace wall and convection-pass surfaces can be cleaned of ash and slag while in operation by the use of sootblowers using steam or air as a blowing medium. The sootblowing equipment directs product air through retractable nozzles aimed at the areas where deposits accumulate.

The convective pass surfaces in the boiler, sometimes referred to as heat traps, are divided into distinct sections in the boiler. Each heat trap normally has its own dedicated set of sootblowing equipment. Usually, only one set of sootblowers is operated at any time, since the sootblowing operation consumes product steam and at the same time reduces the heat transfer rate of the heat trap being cleaned.

TABLE I

| Commercial Fuels for Steam Production | |
|---|---|
| Fuels Containing Ash | Fuels Containing Little or No Ash |
| All coals | Natural gas |
| Fuel Oil - "Bunker C" | Manufactured gas |
| Refinery Sludge | Code-oven gas (clean) |
| Tank residues | Refinery gas |
| Refinery coke | Distillates |
| Most tars | |
| Wood and wood products | |
| Other vegetable products | |
| Waste-heat gases (most) | |
| Blast-Furnace gas | |
| Cement-kiln gas | |
| Black Liquor | |

The sequencing and scheduling of the sootblowing operation can be automated by using controls. See U.S. Pat. No. 4,085,438 to Butler, Apr. 18, 1978, for example.

A common practice for sootblowing scheduling is one utilizing fixed time sequences for the boiler cleaning equipment. The timing sequence is established based on plant measurements during startup. This approach does not allow for the on-line adaptation of the sootblowing sequences. Therefore, changes in boiler operation and unit characteristics are not accounted for in this method.

Sootblowing is also commonly done via "operator inspection", which is usually incomplete and leads to over-cleaning and waste of sootblowing steam.

One of the approaches to sootblowing optimization is the calculation of heat transfer coefficients utilizing a mathematical model of the unit and process measurements to determine sootblowing sequences.

A boiler diagnostic package which can be used for sootblowing optimization has been proposed by T. C. Heil et al in an article entitled "Boiler Heat Transfer Model for Operator Diagnostic Information" given at the ASME/IEEE Power Gen. Conference in Oct. 1981 at St. Louis, Mo. The method depends upon estimates of gas side temperatures from coupled energy balances, and the implementation requires extensive recursive computations to solve a series of heat trap equations. This method is used to estimate heat transfer fouling factors. These intermediate results are then used as input to a boiler performance model based on steady state design conditions to estimate cost savings resulting from sootblower initiation. There is no economic optimization, however, and the method does not account for dynamic changes in incremental steam cost. Also the calculations required to accurately model the unit are quite complex and require complicated recursive techniques to solve the equations. Steadystate design conditions (warranty data) are also required to estimate fouling factors of the individual heat traps.

This scheme quantifies the "operator inspection" method. Numerical values indicate the actual levels of fouling and potential savings from cleaning, but this data is not balanced against cost of cleaning and the rate of performance degradation to predict optimal cleaning times.

In considering the above-mentioned approaches to scheduling of boiler cleaning equipment, the following are desired points of a new optimization scheme:

- On-line adaptation of sootblowing scheduling;
- Use of simple computational algorithm so that a computer is not required;
- No requirement for warranty test data;
- Incorporation of economic consideration;
- Accounting for interactions between various boiler sections;
- Allowing for variable definition of heat traps;
- Use of available process measurements;
- Accounting for variations in cycle times with variations in system parameters such as load; and
- Insensitivity to ambient conditions such as fuel analysis and atmospheric temperature.

SUMMARY OF THE INVENTION

The objective of on-line boiler tube cleaning (sootblowing) optimization is to predict the optimal times to start the individual cleaning units for the various heat traps. Many factors affect the optimal sootblowing schedule and must be considered in any optimization scheme. The present invention utilizes a new approach in calculating sootblowing schedules, while still providing the necessary flexibility to incorporate specific safety and operating features relevant to individual boilers.

The method of this invention provides for an on-line adaptation of the sootblowing sequence. Computation of the optimum sootblowing schedule requires a standard boiler efficiency calculation. Therefore, the only process measurements necessary are generally available. Calculations are provided for an optimum schedule, based on economic considerations while accounting for the interactions between various heat transfer sections. The method involves a straightforward calculation which is easy to comprehend. The method does not require any design or warranty data for the calculation, and is sufficiently flexible to incorporate various operation considerations.

Accordingly, an object of the present invention is to provide a method for optimizing a sootblowing period for a boiler, in particular a boiler having a plurality of heat traps each equipped with its own sootblowing equipment.

A further object of the invention is to provide such a method wherein the heat trap with the most advantageous optimum sootblowing period is selected for a sootblowing operation.

A still further object of the invention is to provide such a method when the optimum period between sootblowing operations, $\theta_{opt}$, is obtained using the relationship:

$$\theta_{opt} = \sqrt{\theta_c^2 + \frac{2S\theta_c}{a}} - \theta_c.$$

Where $\theta_C$ is the duration of a sootblowing operation, S is the cost for a sootblowing operation and a is the average slope of an efficiency loss curve for the boiler.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings

FIG. 1 is a schematic side elevational view of a boiler having a plurality of heat traps;

FIG. 2 is a graph showing a course penalty plotted against a time between sootblowing operations;

FIG. 8 is a schematic diagram of a logic circuit for obtaining a difference between an optimum and an actual time between sootblowing operations;

FIG. 10 is a schematic diagram of a logic circuit for one heat trap used to control the sootblowing operation.

DESCRIPTION OF THE PREFERRED EMBODIMENT

Figure 3:
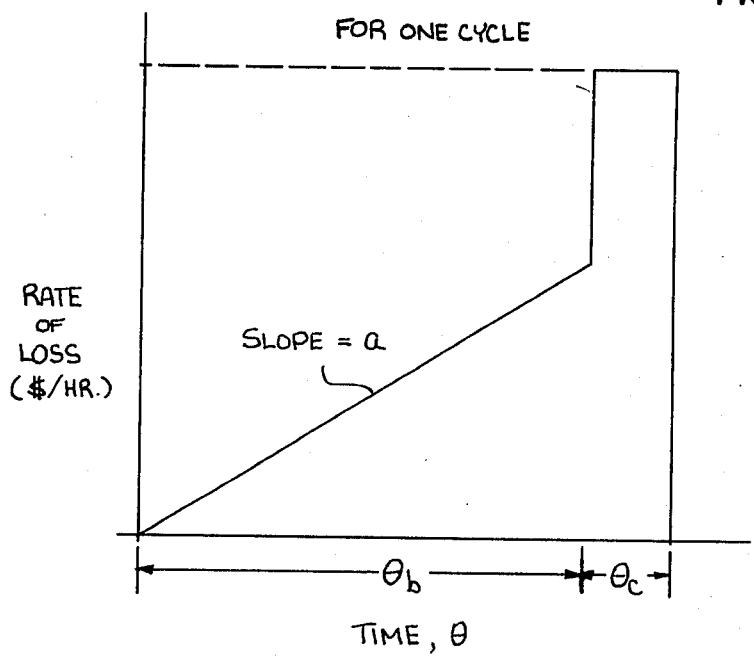
FIG. 3 is a graph showing a rate of loss of efficiency against time, as a sootblowing operation becomes more necessary.

Referring to the drawings, and FIG. 1 in particular, a method for optimizing a sootblowing schedule or cycle time in a boiler generally designated 10, is provided. The boiler 10 includes a plurality of zones which include, for example, platens 12, secondary superheater 13 with input and output portions, heater 14, primary superheater 16, and economizer 18.

The approach used in this equation scheme is to minimize the economic cost penalty associated with sootblowing. The major cost factors dealt with in this method are:

Cost due to loss of efficiency of the boiler;

Cost to operate sootblowers; and

Long-term boiler degradation cost.

Using these factors, an objective function may be defined for individual heat traps as shown in FIG. 2. The definition of a heat trap is a set of sootblowing equipment which is designed to operate in a group fashion; for example, the sootblowers associated with the boiler economizer section 18 may be established as a heat trap. It should be noted that the definition of a heat trap group does not require specific spatial orientation for the sootblowers, but allows any desired pattern.

The inventive method models the rate of fouling and employs the model in schedule optimization. The model adapt to on-line process measurements, and thus provides accurate results for changing boiler characteristics. The implemented sootblowing sequence is a product of the optimal cycle times, safety constraints, operator set points, and interaction with other heat traps. The cycle time for an individual heat trap is computed independently but is considered as part of the overall boiler structure.

One form of this model is shown in FIG. 3. More complex models may be used, yet the basic concepts of this invention hold. The rate at which the buildup of soot affects the total boiler efficiency is shown to follow linear profile at slope =a. The cost of running the sootblowing equipment is taken as a fixed cost S during period $\theta_c$. So the problem of adapting the model to the plant characteristics becomes one of estimating the rate of accumulation of soot or the value of slop a and cost to run the sootblowers during time period $\theta_c$. In FIG. 3, $\theta_b$ is cycle time for the heat trap in question (the ith heat trap, and $\theta_c$ is its cleaning time.

It is assumed that cost of sootblowing can be determined from design specifications, or measured directly from on-line measurements. The rate of soot accumulation is inferred from the change in total boiler efficiency during the time the set of sootblowers are operational. Thus:

$$\Delta\xi i = \xi 2i - \xi i \quad (1)$$

where:

$\Delta\xi i$ is changed in boiler efficiency due to cleaning heat trap;

$\xi 2i$ is boiler efficiency after sootblowing the ith heat trap; and $\xi 1i$ is boiler efficiency before ith heat trap is cleaned.

Figure 4:
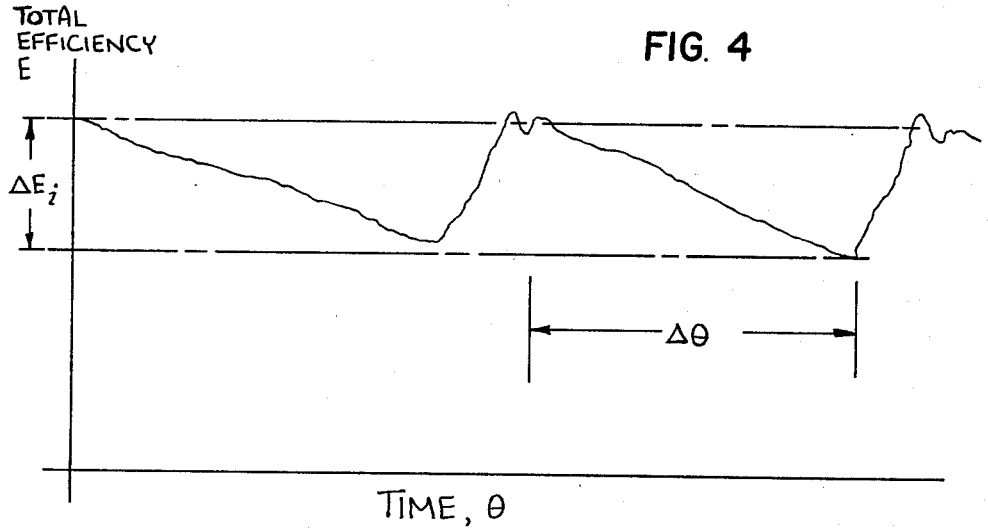
FIG. 4 is a graph showing the overall efficiency of the boiler over time, and including two sootblowing steps.

FIG. 4 shows and example of the measurements taken to estimate the change in boiler efficiency due to sootblowing one heat trap. In order to account for the interactions between the various heat traps and reduce the effect of noise in the process measurements, the rate of efficiency loss is calculated using a discrete filtering technique as follows:

$$E_{Ni} = \frac{\Delta\xi_i}{\theta_B} \quad (2)$$

$$E_{AVi} = (1 - X)E_{AVi} + X \cdot E_{Ni} \quad (3)$$

-continued $$ai = E_{AVi} \cdot \text{LOAD} \cdot (\text{Energy Cost}) \quad (4)$$

$$E_{AVi} = (l - X)\, E_{AVi} + X \,.\, ENi \quad (3)$$

$$ai = E_{AVi} \,.\, \text{LOAD.(Energy Cost)} \quad (4)$$

where:

$E_{Ni}$ is instantaneous efficiency loss (%) for the ith heat trap;

$E_{AVi}$ is average instantaneous efficiency loss (%);

X is the filter constant;

Load is boiler load ($lb_{steam}$/hr); and ai is the average slope of the efficiency loss curve of the period $\Delta\theta$($lb_{steam}$/$hr^2$).

The same model is used for each heat trap. Parameter identification for each heat trap model is calculated independently and on-line. Only process measurements for the boiler efficiency estimate and the sootblowing start-stop signals of individual heat traps are required.

Figure 5:
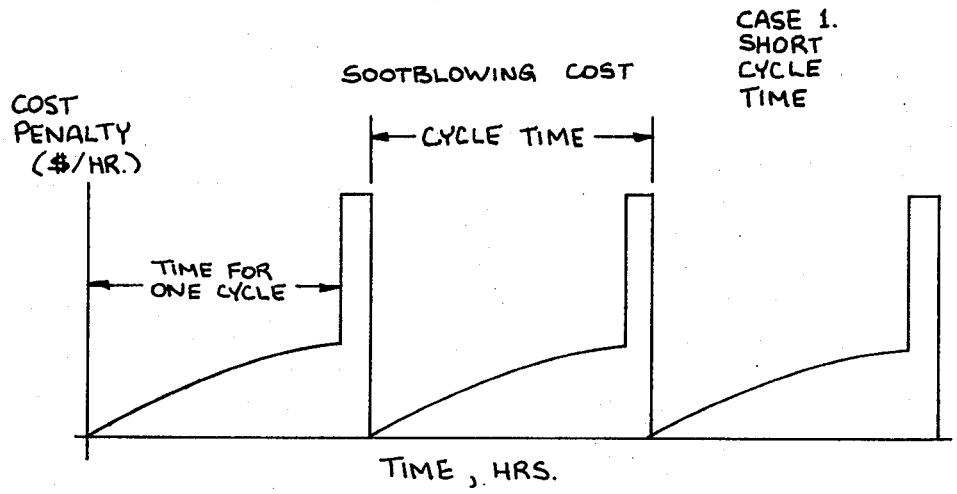
FIG. 5 is a graph plotting course penalty against time for a short cycle sootblowing operation.
Figure 6:
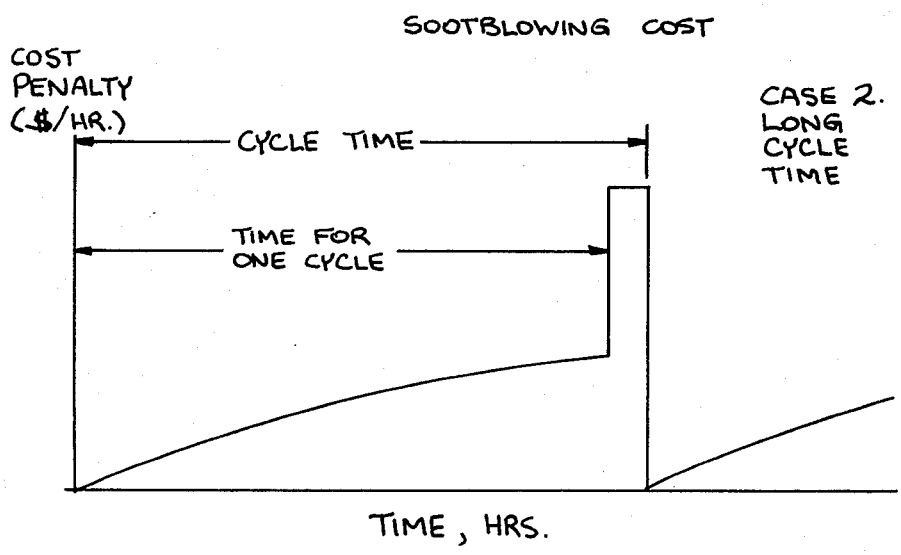
FIG. 6 is a graph similar to that of FIG. 5 showing a long cycle sootblowing operation.

The optimization calculations which are performed using the model and the identified parameters for the curves will now be described. An objective function, comprising the cost of sootblowing and losses due to decrease in boiler efficiency, is minimized by selecting the optimum cycle time $\theta_b$ for each heat trap. In FIGS. 5 and 6 the impact of cycle time on the sootblowing penalty costs is presented for a short or a long cycle time. The problem is then to minimize the penalty costs (area under the curves). The optimization to minimize the losses is as carried out as follows: Cost Penalty per cycle:

$$\text{Cost} = \int_0^{\theta_b} (a \times t)dt + S \times \theta_c = \frac{a}{2}\theta_b^2 + S \times \theta_c \quad (5)$$

where a is rate of efficiency loss per heat trap $$\left(\frac{\$}{hr^2}\right);$$

and

S is the cost of a sootblowing operation $$\left(\frac{\$}{hr}\right).$$

To find the optimum cycle time, $\theta_b$, one must minimize losses over an arbitrary time (Q hours), $$\frac{\$\text{Lost}}{Q\text{hours}} = \left(\frac{a}{2} \cdot \theta_b^2 + S \cdot \theta_c\right)\left(\frac{Q}{\theta_b + \theta_C}\right) = (\$_{Lost}/\text{Cycle})\left(\frac{\#\text{ of cycles}}{Q\text{hours}}\right) \quad (6)$$

The minimization is achieved by taking the derivative of equation (6) with respect to $\theta_b$, or:

$$\frac{d}{d\theta_b}\left(\frac{\$\text{Lost}}{Q\text{hours}}\right) = \phi = \frac{d}{d\theta_b}\left(\frac{a}{2}\theta_b^2 + S \cdot \theta_c\right) \times \left(\frac{Q}{\theta_b + \theta_c}\right) \quad (7)$$

$$\phi = \frac{\left[(\theta_b + \theta_c)a\theta_b - \frac{a}{2}\theta_b^2 - S \cdot \theta_c\right] \times Q}{(\theta_b + \theta_c)} \quad (8)$$

The sequencing logic is designed so as to allow for the addition of constraint criterion, (for example, high $\Delta P$ measurements), on top of the optimization. This allows the specific constraints of the plant to be treated without requiring a design change to the optimization algorithm:

$$\phi = \frac{a}{2}\theta_b^2 + a\theta_c\theta_b - S\theta_c \quad (9)$$

Solving for optimum cycle time $\theta_b = \theta_{opt}$ the Quadratic formula:

$$\theta_{opt} = \frac{-a\theta_c \pm \sqrt{a^2\theta_c^2 + 4\frac{a}{2}S\theta_c}}{a} = -\theta_c \pm \sqrt{\theta_c^2 + \frac{2S\theta_c}{a}} \quad (10)$$

Since $\theta_{opt}$ is a positive value, the value for $\theta_{opt}$ is:

$$\theta_{opt} = \sqrt{\theta_c^2 + \frac{2S\theta_c}{a}} - \theta_c \quad (11)$$

Figure 7:
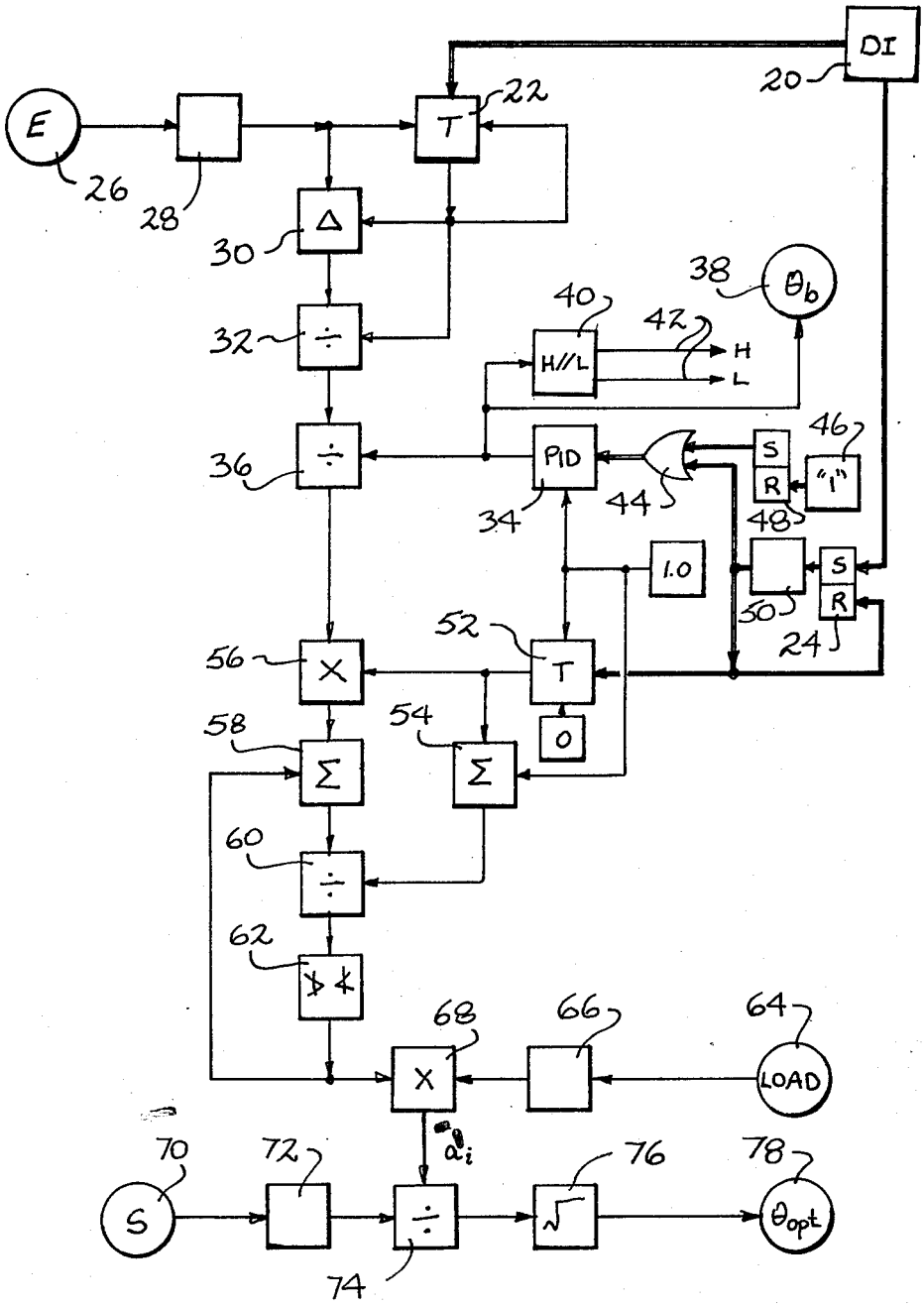
FIG. 7 is a schematic diagram of a logic circuit for obtaining an optimum sootblowing period for each heat trap.

FIG. 7 represents the configuration logic necessary to implement the invention.

Figure 9:
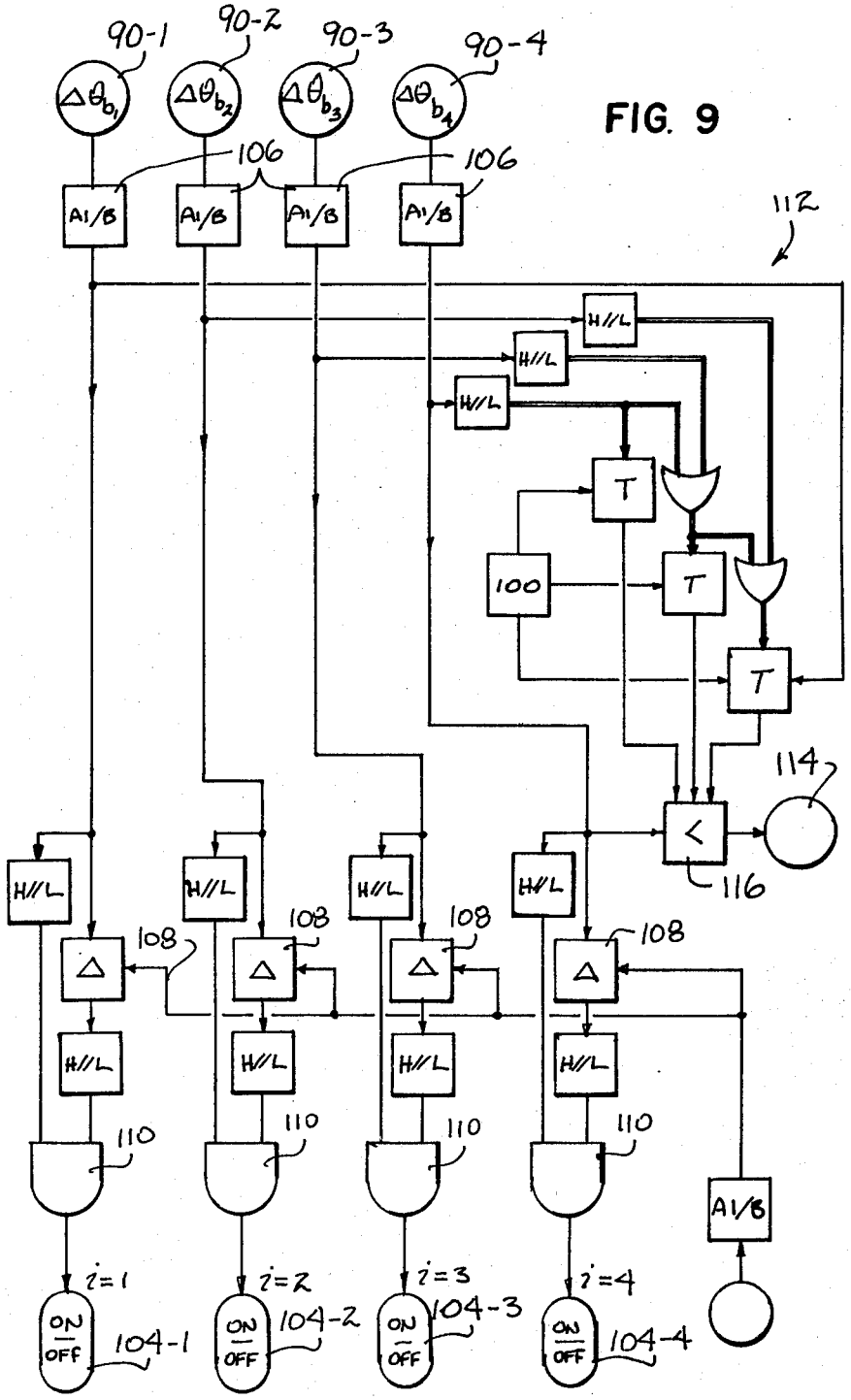
FIG. 9 is a schematic diagram of a logic circuit for selecting one of a plurality of heat traps for sootblowing.

The optimal economic sootblowing cycle time will be determined for each heat trap for Equation (11). These optimum cycle times ($\theta_{opt}$) can be compared with the respective $\theta_b$ for each heat trap to determine sootblower sequencing priority if more than one heat trap has a cycle time greater than the optimum cycle time (see Table II). The generating bank would be the first section to be cleaned. The sootblowers for the second generating bank would be the next set of sootblowers to be initiated. FIGS. 8, 9 and 10 represent the configurational logic used to implement the sequencing strategy.

TABLE II

| Heat Trap | Optimum Cycle Time $\theta_{opt}$, minutes | Time Since Start of Cycle $\theta_b$ minutes | $\theta_{opt} - \theta_b$ minutes |
|---|---|---|---|
| Secondary Superheater | 83 | 84 | −1 |
| Reheat Superheater | 104 | 95 | 9 |
| Primary Superheater | 155 | 110 | 45 |
| Reheating Superheater | 176 | 15 | 161 |
| Economizer | 240 | 174 | 66 |

A microprocessor-based NETWORK 90 distributed control instrumentation can be used to implement the method of the present invention and FIGS. 7 to 10, without a process computer (NETWORK 90 is a trademark of the Bailey Controls Company of Babcock and Wilcox, A McDermott Company).

In the past, higher level supervisory controls, have been implemented in process computers. Bailey's microprocessor-based NETWORK 90 control instrumentation provides an alternative to process computers for application of advanced control algoritham and higher level control in energy management, As noted above, FIG. 7 is a logic circuit which can be utilized to obtain optimum cycle times $\theta_{opt}$. A signal for starting a sootblowing operation is initiated in DI element 20 and sent to a signal transmitter 22 and an SR unit 24.

While the circuit of FIG. 7 is for a single heat trap, there being such a circuit for each heat trap, a value corresponding to the overall boiler efficiency E is provided from element 26 over a signal processing unit 28 to another input of transmitter 22. The instantaneous efficiency for the boiler can be calculated in any known fashion, using for example a differential between the input and output temperatures, or other known methods.

The instantaneous efficiency is also supplied to a difference unit 30. Transmitter 22 is operable to periodically supply the instantaneous efficiency to another input of difference unit 30, so that a difference in efficiency over a known time period is established. This value is divided once more by the instantaneous efficiency in division unit 32 whose output is divided by an actual soot blowing cycle time $\theta_b$ supplied by PID unit 34 to a second dividing unit 36.

The actual sootblowing cycle time $\theta_b$ is provided to an output element 38 for other uses. The same value is provided to a HIGH/LOW unit 40 which provides high and low signals over lines 42 when the sootblowing period rises above or falls below set limits. Lines 42 can be utilized to activate an alarm or other suitable equipment.

PID 34 is controlled by an OR unit 44 by either a signal from a "1" value input 46 over an SR unit 48 or the output of SR unit 24 over a signal processing unit 50.

A filter constant for the heat trap is established by a second transmitter 52 and a summing unit 54. The factor is multiplied by the output of dividing unit 36 in a multiplier 56. The output of multiplier 56 is supplied to a summing unit 58, a third dividing unit 60 and a unit 62 for establishing maximum and minimum values, in sequence. The filter constant is also provided to third dividing unit 60 and the output of limiting unit 62 is provided back to summing unit 58.

A signal proportional to the plant load is supplied by load unit 64 over a signal processor 66 to a further multiplier 68 which multiplies a signal proportional to the load by the output of element 62 to produce the value $a_i$ corresponding to the average slope for the efficiency loss curve.

A cost factor S is provided by cost factor unit 70 to a signal processor 72 and a further multiplying unit 74, the output of which is subjected to a square root operation in square root unit 76 to produce the optimum sootblowing cycle time $\theta_{opt}$ at 78.

The signal processors 28, 50, 66 and 72 are provided for rendering the input signals compatible with the logic circuitry. The circuit of FIG. 7 is thus usable to make the calculation of equation (11).

FIG. 8 shows a logic circuit for obtaining the difference between optimum and actual sootblowing periods for each heat trap of the boiler. Four such circuits can be used where four heat traps are provided for obtaining the difference values $\Delta\theta_{b1}$, $\Delta\theta_{b2}$, $\Delta\theta_{b3}$ and $\Delta\theta_{b4}$.

These values can be utilized in the circuit of FIG. 9 to determine the priority of sootblowing among the four heat traps.

In FIG. 8, unit 78 and 38 for carrying the respective optimum and actual sootblowing periods for the ith heat trap are supplied to a difference unit 84 of signal processes 80 and 82. The difference signal is provided over signal transmitters 86 and 88, each operated by a manual/auto switch 100 over a signal generator 102, to supply the difference value $\Delta\theta_{bi}$ in units 90.

As shown in FIG. 9, the difference between actual and optimum sootblowing periods are supplied for each heat trap 1 through 4 at respective locations 90-1, 90-2,90-3,904. The signals are each processed in elements 106 for rendering the signals compatible with the remainder of the logic circuit.

The sootblowing equipment (not shown) is controlled by on-off controllers 104-2, 104-3 and 104-4. As shown, several high/low controllers (labelled H//L) are used in conjunction with four difference units 108 and four AND gates 110 to selectively initiate sootblowing in one of the four heat traps.

A portion of the logic circuit generally designated 112 determines and displays which of the sootblowers is operating, and which should be operating, at display 114. This circuit includes a low value unit 116, three transmitters (labeled T), two OR gates, three high/low units and an initial value unit for providing an initial value to the transmitters.

FIG. 10 shows an additional control circuit which is used for each of the heat traps so that four of the circuits is necessary for a boiler having four heat traps.

Controllers 120 and 122 are controlled by high $\Delta P$ and minimum timer 124 and 126 respectively.

Depending on the mode of operation, a manual or an auto signal is provided to OR gate 128, which outputs to an AND gate 130 having an inverting input connected to a low or minimum time unit 132 and a non-inverting input connected to an element 134 which provides a signal when a sootblowing operation is in progress. An OR gate 136 has three inputs, one connected to unit 124, one to 126 and one to the output of AND gate 130. The output of OR gate 136 is provided to an AND gate 138 having another input connected to an AUTO/-MANUAL element 140 which provides a signal to the AND gate 138. The AND gate 138 is connected to one of three terminals of an ON/OFF unit 142, another terminal of which is connected to a unit 144 which provides a signal when a sootblowing operation is completed, and the final terminal of which is connected to an OR gate 146. OR gate 146 has one input connected to an output of AND 138 and the other input being inverted and connected to the output of unit 140.

The sootblowing unit with the most advantageous and economical sootblowing period is thus selected for a sootblowing operation by the circuits of FIGS. 9 and 10.

While a specific embodiment of the invention has been shown and described in detail to illustrate the application of the principles of the invention, it will be understood that the invention may be embodied otherwise without departing from such principles.

What is claimed is:

1. A method of optimizing the scheduling time for sootblowing in one of a plurality of heat traps in boiler, comprising:

Obtaining a fixed cost value S corresponding to the cost of running a sootblowing operation for the heat trap;

calculating the average slope (a) for a loss of efficiency during a period between sootblowing operations for the heat trap;

determining the length ($\theta_c$) for a sootblowing operation of the heat trap; and calculating the optimum duration between sootblowing operations ($\theta_{opt}$) according to the relationship:

$$\theta_{opt} = \sqrt{\theta_c^2 + \frac{2S\theta_c}{a}} - \theta_c.$$

2. A method according to claim 1, wherein the average slop is calculated by calculating the instantaneous efficiency ($E_{Ni}$) for the heat trap, obtaining a filter constant (X) for the heat trap, obtaining an average instantaneous efficiency loss value ($E_{AVi}$) from the relationship $$E_{AVi}=(1-X)\,E_{AVi}+X\,.ENi,$$

measuring the energy cost and load for the boiler, the slope being equal to the product of the average instantaneous efficiency loss, the load and the energy cost.

3. A method according to claim 2, wherein the instantaneous efficiency loss ($E_{Ni}$) is calculated by measuring a change of boiler efficiency due to the sootblowing of the heat trap and dividing the change of efficiency by the actual time between sootblowing operations for the heat trap.

4. A method according to claim 1, including measuring the actual duration between sootblowing operations for each of a plurality of heat traps in the boiler, obtaining the optimum duration between sootblowing operations for each of the heat traps, calculating the difference between the actual and optimum durations for each heat trap and selecting the heat trap having the greatest difference for the next sootblowing operation.

* * * * *